US006012446A

United States Patent [19]

Ebbeson

[11] Patent Number: 6,012,446

[45] Date of Patent: Jan. 11, 2000

[54] FUEL CONTAINER FOR A SPIRIT STOVE

[75] Inventor: Bengt Ebbeson, Ettenhausen, Sweden

[73] Assignee: Aktienbolaget Electrolux, Stockholm, Sweden

[21] Appl. No.: 09/135,259

[22] Filed: Aug. 17, 1998

[30] Foreign Application Priority Data

Sep. 4, 1997 [SE] Sweden ..... 9703188

[51] Int. Cl.[7] ..... F24C 5/00; F24C 5/04

[52] U.S. Cl. ..... 126/45; 220/88.1; 431/320

[58] Field of Search ..... 220/88.1, 88.2; 431/320, 323; 126/45, 43

[56] References Cited

U.S. PATENT DOCUMENTS 4,544,348 10/1985 Boij ..... 126/43

FOREIGN PATENT DOCUMENTS 2648601 5/1978 Germany ..... 126/43

*Primary Examiner*—Allan N. Shoap
*Assistant Examiner*—Joe Merek
*Attorney, Agent, or Firm*—Pearne, Gordon, McCoy & Granger LLP

[57] ABSTRACT

A fuel container (10) for a spirit stove, including a can-shaped lower part (11), a cover (12), a net and a spacer for maintaining a space between the cover and the net. The cover has an inner edge which defines an opening (15). The opening receives an upwardly extending portion (18) of the net (17). The net extends below the cover and is held in position in the fuel container. The spacer (20, 21) is arranged between the net and the cover. An absorbing mass (14) is disposed within the fuel container for absorbing liquid fuel. The upwardly extending portion (18) of the net (17) has an area which is less than an area of the opening (15), thereby creating a passage (23) between the inner edge of the cover and the upwardly extending portion (18) of the net through which fuel may flow into the container.

12 Claims, 2 Drawing Sheets

FUEL CONTAINER FOR A SPIRIT STOVE

BACKGROUND OF THE INVENTION

The present invention generally relates to a fuel container and, more particularly, to a spirit stove fuel container having a can-shaped lower part, a cover secured to the lower part and defining an opening, a net extending below the cover, distance means arranged between the net and the cover, and an absorbing mass within the fuel container for absorbing liquid fuel.

Spirit stoves incorporating fuel containers are well known and have been extensively used as camping stoves, and as cooking stoves for boats, mobile homes and the like. The absorbing mass, which usually is mineral wool, is covered by a metal net which retains the mass and the absorbed fuel in the fuel container even if the container is turned up-side-down. During combustion, the fuel evaporates from a free surface of the absorbing mass within the opening of the cover. The fuel container is filled by removing the container from the stove and pouring fuel directly into the opening. However, since the net extends over the complete area of the cover opening, and tightly abuts the edge of the opening, together with the mass beneath, the surface area presented by the mass for absorption of fuel is small and the fuel flows slowly down into the container.

To fill the fuel container completely from a spirit bottle may take as long as 5 minutes. However, the risk for spillage is great, particularly on moving boats, and when fuel is spilled there is a serious risk of fire.

In order to shorten the filling time and facilitate filling it has been suggested to use an arrangement, described in U.S. Pat. No. 4,416,617, wherein a slotted tube extends into the absorbing mass. To fill the container, a funnel is inserted into the tube, the container is tilted, and fuel is poured into the funnel. The fuel is absorbed by the mass through the slot and through the open end of the tube. However, with this method there usually is fuel left in the funnel when the container is full. Accordingly, the remaining fuel in the funnel will flow out above the edge of the opening before filling is stopped. Moreover, the passage from the tube to the mass is narrow and filling proceeds slowly.

It is also previously known to use a net that has a small, circular depression at the edge of a central circular portion which extends upwards into the circular opening such that the edge of the circular portion abuts the edge of the circular opening. Outer parts of the net and/or the cover are provided with radially extending ridges forming a free space between the net and the cover in order to vent fuel vapor when the fuel becomes warm and which would otherwise permit the fuel to flow out through the opening. The depression is placed at an edge of the circular portion and is used as a fuel level indicator. The fuel container is filled, after being removed from the spirit stove, by pouring fuel into the opening. Thus, the liquid fuel flows through the net, into the fuel container, and down into the absorbing mass. By tilting the fuel container with the circular depression downwardly it is possible to observe the level of the fuel and pour fuel into the container until the fuel container is filled to its maximum level. However, this method is cumbersome and time consuming, especially if care is taken to avoid fuel spillage.

The above-mentioned fuel container can also be filled by using a small cup-shaped piece of plastic or metal. The cup-shaped piece is inserted between the net and the cover before filling and forms a funnel into which fuel is poured when the container has been tilted. When the container is full, the piece is removed. However, the absorbing area of the mass is unchanged, which means that the time required to fill the container is the same. Another disadvantage is that loose small details, such as the small cup-shaped piece, are easily misplaced.

SUMMARY OF THE INVENTION

An object of the present invention is to decrease the time required to fill a spirit stove fuel container. Another object of the present invention is to minimize the possibility of spilling fuel during filling of a spirit stove fuel container.

In accordance with the present invention, a fuel container includes a can-shaped lower part and a cover a cover secured to the lower part and having an inner edge defining an opening. An absorbing mass is disposed within the fuel container for absorbing liquid fuel.

In further accordance with the present invention, a net is disposed in the container relatively between the absorbing mass and the cover. A spacer or distance means is arranged between the net and the cover.

In further accordance with the present invention, the net has an upwardly extending portion which extends into opening in the cover. The upwardly extending portion of the net has an area which is less than an area of the opening to define a passage between the inner edge of the cover and the upwardly extending portion of the net.

BRIEF DESCRIPTION OF THE DRAWINGS

These and further features of the present invention will be apparent with reference to the following description and drawings, wherein.

DETAILED DESCRIPTION OF THE PREFERRED EMBODIMENT

Figure 1:
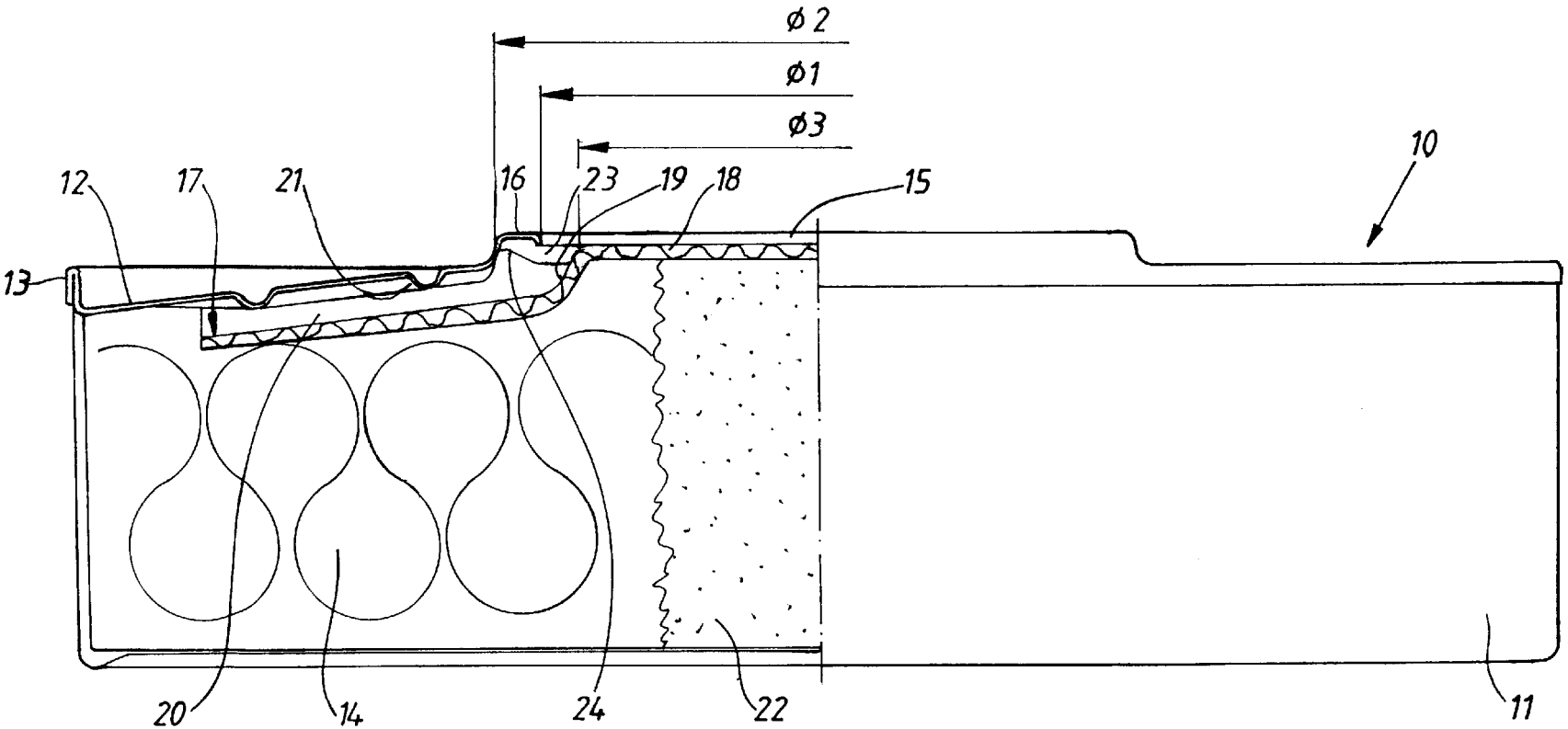
FIG. 1 is a vertical section through a fuel container according to the present invention.
Figure 2:
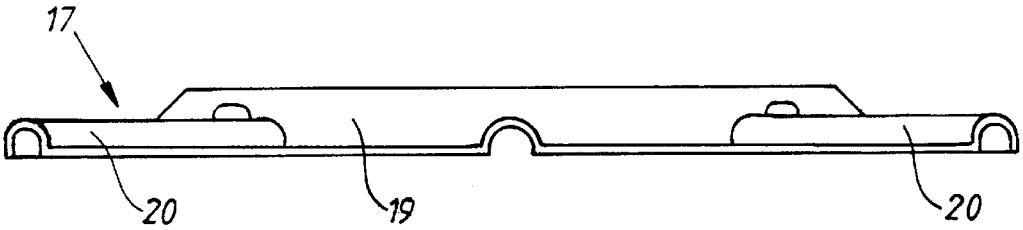
FIG. 2 is a side view of a net being used in the container shown in FIG. 1; and, FIG. 3 is a top plan view of the net shown in FIG. 2.
Figure 3:
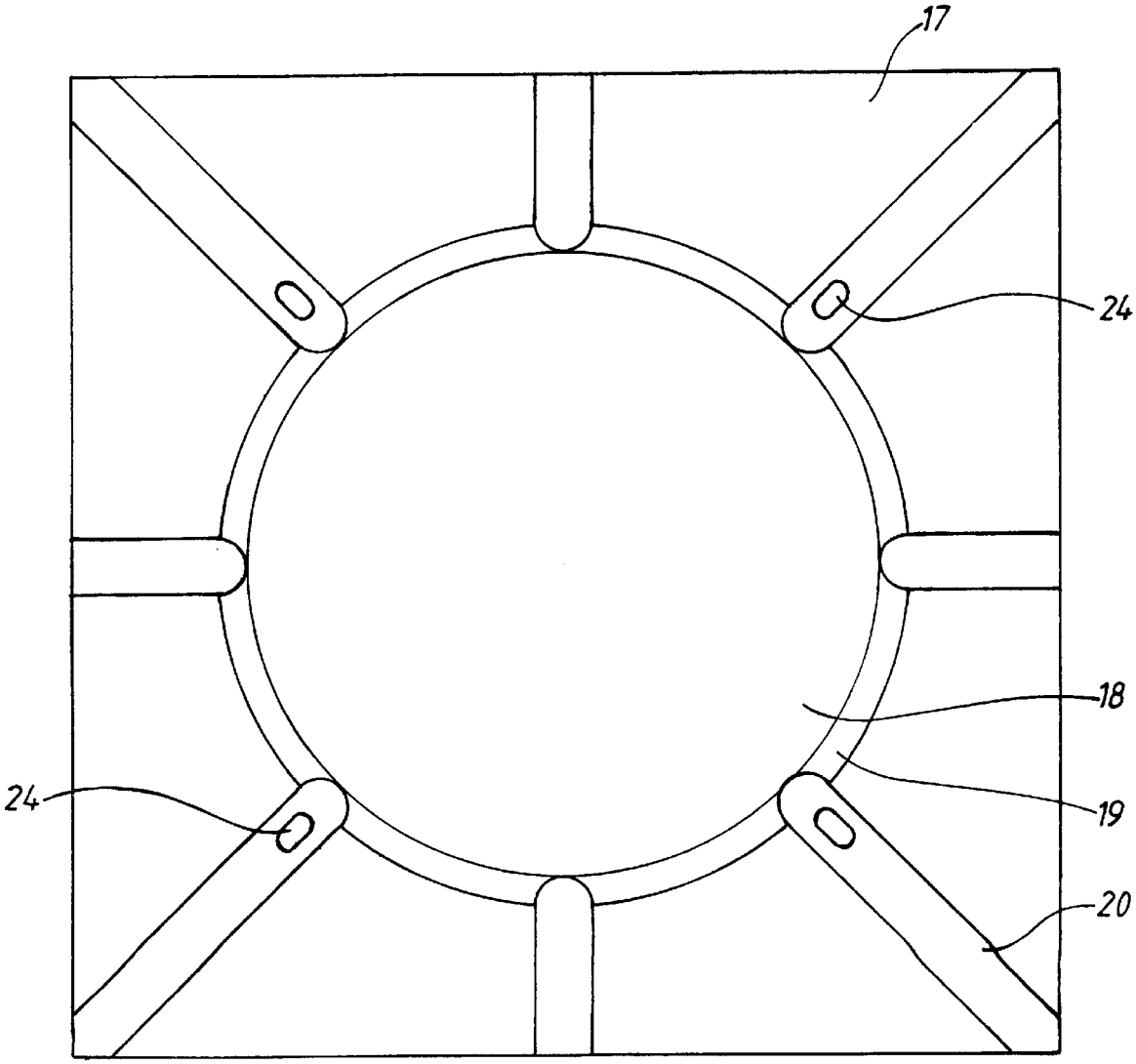

With reference to the drawing figures, a spirit stove fuel container 10 according to the present invention includes a circular, can-shaped lower part 11 of sheet metal, preferably stainless steel, and an annular cover 12. The cover 12 is secured to the lower part 11 by means of a fold 13. An absorbing mass 14 is disposed within the fuel container 10. The absorbing mass 14 is preferably made from a mineral wool, such as glass wool, and absorbs and stores liquid fuel which is to be burned in the stove.

The cover 12 of the fuel container 10 has a circular opening 15 which is surrounded by a rim 16. The rim 16 has an inner edge with an inner diameter Φ1 and an outer edge with an outer diameter Φ2. The inner edge and inner diameter Φ1 correspond to the opening 15. The absorbing mass 14 is covered by a grating or a net 17, which is preferably formed from stainless steel. The net 17 is disposed within the container 10 generally between the cover 12 an upper surface of the mass 14. The net 17 retains the mass 14 within the fuel container 10 and prevents the mass from being pushed out through the opening 15.

The net 17 has an upwardly extending center circular portion 18 with a circular edge part 19. The upwardly extending portion 18 extends into the opening 15 in the cover 12, as illustrated. An outer portion of the net 17 extends away from the center circular portion 18 and is disposed beneath the cover 12. The center circular portion 18 has a diameter Φ3 which is less than the inner diameter Φ1 of the opening 15 in the cover 12. The net 17 has a series of upwardly extending, radial ridges 20 which extend from the center circular portion 18 toward a peripheral edge of the net 17.

The cover 12 includes annular ridges 21 which surround the opening 15 and extend downwardly toward the net 17 and the interior of the container 10. The ridges 20, 21 on the net and cover define distance means which cooperate to maintain a space between the cover 12 and the net/mass. Although the illustrated ridges 20, 21 are the preferred distance means to maintain a space between the cover and the net, it is contemplated that other spacers could be used with equal functionality and without departing from the present invention. Preferably, a wick material 22 is also disposed in the fuel container 10 to draw fuel from the bottom of the container 10 up to the net 17 by capillary action.

Since the upwardly extending center circular portion 18 of the net 17 has a diameter (Φ3) which is less than the inner diameter (Φ1) of the rim 16 defining the opening 15, an annular slot 23 is formed between the rim 16 and the portion 18. Accordingly, when fuel is poured into the container through the opening 15, some fuel will be absorbed by the mass 14 directly beneath the center circular portion 18 of the net 17 and some fuel will flow into the slot 23 and then into the space between the cover 12 and the net 17, i.e., away from the center circular portion 18, where it is absorbed by the mass 14. Thus, the fuel will quickly be distributed over almost the complete upper surface of the mass 14.

The more even distribution of fuel provided by the arrangement according to the present invention increases the surface area available to absorb fuel and shortens the filling time considerably. The distance between the cover 12 and the net 17 is preferably greater than 1 mm and preferably about 5 mm.

In order to center the net 17 in the opening 15, it is preferred that the net include several upwardly extending beads 24. The beads 24 are received in an annular groove 25 defined on the underside or inwardly facing side of the rim 16 and relatively between the inner edge and outer edge of the rim, as illustrated. Preferably, the beads 24 engage the inwardly facing side of the outer edge of the rim 16, as illustrated, and prevent movement of the net 17 relative to the opening 15 in the cover 11. Naturally, numerous alternative net centering means could be employed with equal functionality and without departing from the present invention.

What is claimed is:

1. A fuel container (10), comprising:

a lower part (11);

a cover (12) secured to the lower part (11) and having an inner edge defining an opening (15);

an absorbing mass (14) within the fuel container for absorbing liquid fuel;

a net (17) disposed in the container relatively between said mass and said cover; and, a spacer (20, 21) arranged between the net and the cover, wherein the net (17) has an upwardly extending portion (18) which extends into said opening, said portion having an area which is less than an area of the opening (15) to define a passage (23) between the inner edge of the cover and the upwardly extending portion (18) of the net.

2. A fuel container according to claim 1, wherein the opening is circular.

3. A fuel container according to claim 1, wherein a space between the upwardly extending portion (18) and the inner edge is greater than 1 mm preferably about 5 mm.

4. A fuel container according to claim 2, wherein a space between the upwardly extending portion (18) and the inner edge is greater than 1 mm preferably about 5 mm.

5. A fuel container according to claim 1, further comprising means (24) for centering the net (17) relative to the opening (15).

6. A fuel container according to claim 2, further comprising means (24) for centering the net (17) relative to the opening (15).

7. A fuel container according to claim 3, further comprising means (24) for centering the net (17) relative to the opening (15).

8. A fuel container according to claim 4, further comprising means (24) for centering the net (17) relative to the opening (15).

9. A fuel container according to claim 5, wherein said centering means (24) comprises beads arranged on the net, said beads abutting the cover (12) radially outside the opening (15).

10. A fuel container according to claim 6, wherein said centering means (24) comprises beads arranged on the net, said beads abutting the cover (12) radially outside the opening (15).

11. A fuel container according to claim 7, wherein said centering means (24) comprises beads arranged on the net, said beads abutting the cover (12) radially outside the opening (15).

12. A fuel container according to claim 8, wherein said centering means (24) comprises beads arranged on the net, said beads abutting the cover (12) radially outside the opening (15).

* * * * *